United States Patent [19]

Forbes, Jr.

[11] 4,360,148

[45] Nov. 23, 1982

[54] SLIDING LID FOR TAPERED TRAY

[75] Inventor: Hampton E. Forbes, Jr., Wilmington, Del.

[73] Assignee: Westvaco Corporation, New York, N.Y.

[21] Appl. No.: 291,822

[22] Filed: Aug. 10, 1981

[51] Int. Cl.[3] ..... B65D 5/64; B65D 43/12

[52] U.S. Cl. ..... 229/43; 220/351

[58] Field of Search ..... 229/43, 7 SC, 17 SC; 220/345, 351, 350

[56] References Cited

U.S. PATENT DOCUMENTS

| | | | |
|---|---|---|---|
| 3,314,585 | 4/1967 | Farrer . | |
| 3,377,017 | 4/1968 | Rosenfield | 229/43 |
| 3,504,843 | 4/1970 | McCrea . | |
| 4,076,168 | 2/1978 | Ferri . | |
| 4,190,191 | 2/1980 | Forbes . | |
| 4,272,010 | 6/1981 | Capo | 229/43 |

FOREIGN PATENT DOCUMENTS

| | | | |
|---|---|---|---|
| 633643 | 12/1949 | United Kingdom | 229/43 |
| 1384547 | 2/1975 | United Kingdom . | |

*Primary Examiner*—Herbert F. Ross

[57] ABSTRACT

A sliding lid is disclosed for use on open top tapered trays having angularly disposed side walls and no top flange. The lid is prepared from a blank of flexible material such as paperboard or the like and comprises a central panel having inside and outside panels and a glue flap foldably attached to each side edge thereof. The inside and outside panels are folded to produce side flaps that are fixed in place when the glue flaps are adhered to the inside of the central panel. In their fixed position, the side flaps are angularly oriented with the lid central panel so as to grip the tapered side walls of the tray when the lid is in place.

9 Claims, 9 Drawing Figures

SLIDING LID FOR TAPERED TRAY

BACKGROUND OF INVENTION

The present invention relates to the food packaging art, and more particularly to a sliding lid closure for a carton for packaging, storing and cooking food.

There is a considerable market for low cost, disposable cartons for packaging food wherein the cartons protect the food packaged therein during shipment and refrigeration, and additionally, may be used for heating and serving the food. Moreover, with the development of thermally stable polymers and paperboard for use in conventional and microwave ovens, disposable food packages prepared from such materials are finding increased popularity.

In general, cartons of the class described and disclosed in the prior art comprise trays or the like which may be prepared on high speed forming equipment. some of these trays include integral closure tops, but most utilize separate closure members that in most cases are adhered to a flange element around the upper edge of the tray. In at least one instance, as shown in British Pat. No. 1,384,547, a lid is provided for a flanged tray which includes side panels that extend downwardly to enclose the sides of the tray. Applicant's prior art patent, U.S. Pat. No. 4,190,191 shows another more typical example of a sliding lid for a flanged tray. Meanwhile, there are few if any teachings in the prior art for sliding lids on trays without flanges. Where the tray does not include an upper or top flange, some other means is required for retaining the lid on the tray.

U.S. Pat. No. 3,314,585 shows a combination lid and tray wherein the end portions of the lid are tucked behind notches provided in the tray side walls. U.S. Pat. No. 3,504,843 shows a sliding lid for a container wherein the outermost edges of the lid are folded around slots provided at the front and rear of the container for holding the lid on the container. Further, U.S. Pat. No. 4,076,168 discloses a carton for food products wherein the lid and tray include integral flange portions which are stapled together. Thus, although the prior art teaches the concept of lids for open top trays without a flange, there is no clear showing of a sliding lid for a tray havig tapered side walls and no integral upper or top flange.

SUMMARY OF INVENTION

The food packaging carton of the present invention includes a tray having tapered side walls and a slide top lid, both of which are preferably, but not necessarily, constructed from paperboard having a thermoplastic, thermally stable coating on at least one of the surfaces thereof. The tray is formed with a generally rectangular base portion having tapered, upstanding side walls. Such trays may be glued or pressed, are formed in a variety of sizes, and may be used as carryout trays, frozen food cartons, single serving institutional packages and most recently for ovenable food packages. As noted hereinbefore, the trays are generally coated on their interior food contacting surfaces with a thermally stable coating such as a polyester coating, and are printed on their exterior surfaces with graphics appropriate for the food packaged. Meanwhile, the slide top lids of the present invention may also have a similar coating on their interior or food contacting surface, and they may be similarly printed with suitable graphics on their exterior surfaces.

The slide top lid of the present invention is formed from a generally rectangular blank of paperboard that is cut and scored to produce a central panel with foldably attached additional panels and a glue flap at two opposed side edges. The additional panels are arranged to be folded adjacent to one another before the glue flaps are adhered to the interior surface of the lid central panel so as to form a pair of side flaps which grip the tapered side walls of the tray. The additional panels are sized so that when folded into side-by-side relation at least one of said panels becomes angularly oriented with respect to the central lid panel in a plane that coincides with the angular orientation of the adjacent tray side wall and the other additional panel assumes an angle with the central lid panel that is slightly less than the angle formed by the first panel. This differential in the angular orientation of the side-by-side additional panels assures that the side flaps will not spread beyond the desired location to provide a secure grip on the tapered side walls of the tray.

DETAILED DESCRIPTION

Figure 1:
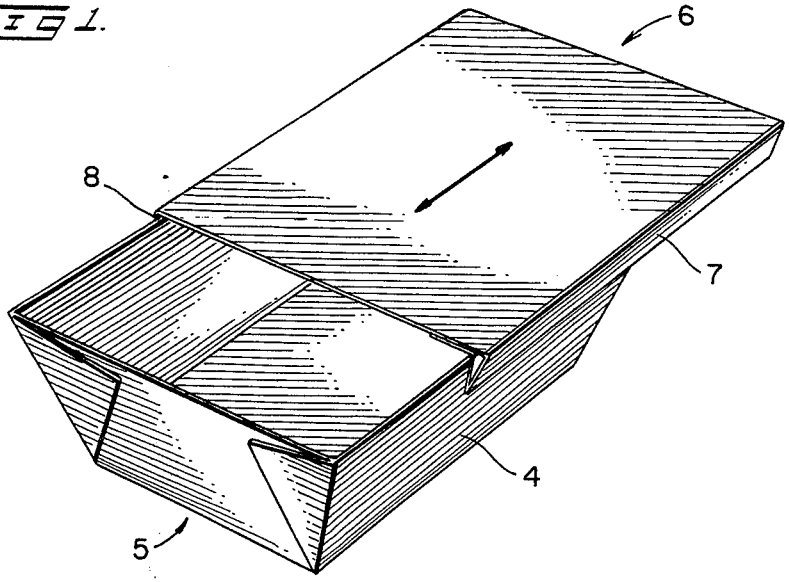
FIG. 1 is a perspective view of the sliding lid and tray combination of the present invention.
Figure 2:
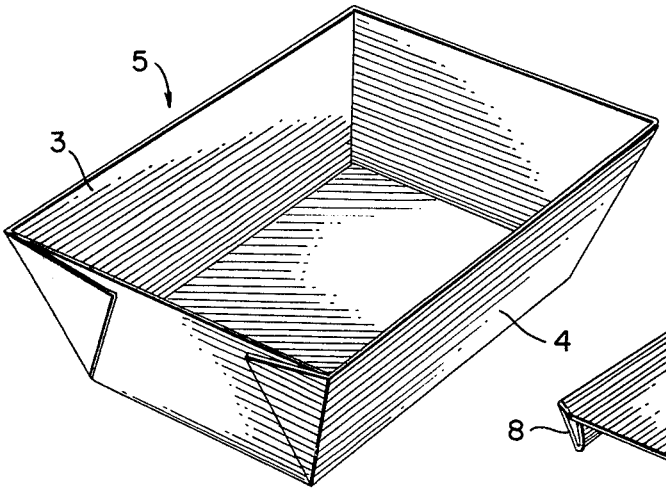
FIG. 2 is a perspective view of the unflanged tray for which the lid is intended.
Figure 4:
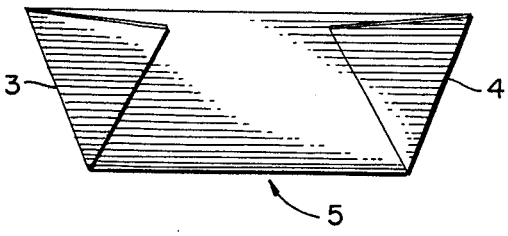
FIG. 4 is an end view of the unflanged tray without a lid.

Referring now to the drawings herein, the sliding lid of the present invention is prepared from a generally rectangular blank of paperboard or the like 10 which has a rectangular central panel 11, and attached at two opposed sides thereof, additional side panels 12,16 and 13,17 for forming the tray gripping side flaps of the novel lid structure. Side panels 12 and 13 are foldably attached to the central panel 11 along score lines 14,15 and side panels 16,17 are foldably attached to panels 12,13 along score lines 18 and 19. Meanwhile, glue flaps 20,21 are foldably attached to panels 16 and 17 along score lines 22,23. The width "c" of the central panel 11 between fold lines 14 and 15 is slightly wider than the width of the tray 5 for which the lid 6 is intended. The extra width is required to permit the side panels 12,16 and 13,17 to be folded and held in place by the glue flaps 20,21 and thereby provide the desired angular relationship in order to achieve the tray side wall gripping action required by the present invention. As shown in FIGS. 1,2 and 4, a typical tray construction 5 for the sliding lid of the present invention includes angularly oriented side walls 3 and 4. The ends of the tray may also be angularly oriented if desired to facilitate stacking, and the tray is preferably formed from a glued paperboard blank.

Figure 3:
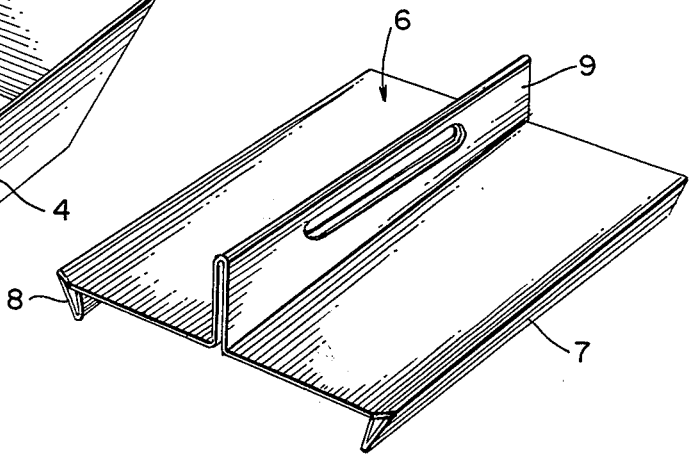
FIG. 3 is a perspective view of a modified embodiment of the sliding lid of the present invention.
Figure 5:
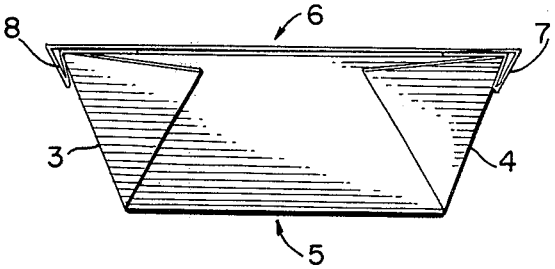
FIG. 5 is an end view of the tray of FIG. 4 with a sliding lid in place.

FIG. 1 illustrates a combination tray 5 and lid 6 showing how the lid is slid on and off the tray. As shown in FIGS. 1 and 5, the angular orientation of the side flaps 7 and 8 is designed to match and grip the angularly oriented side walls 3 and 4 of the tray 5. Meanwhile, FIG. 3 illustrates a modified sliding lid 6 which includes an integral handle element 9 in addition to the angularly oriented side flaps 7,8.

Figure 6:
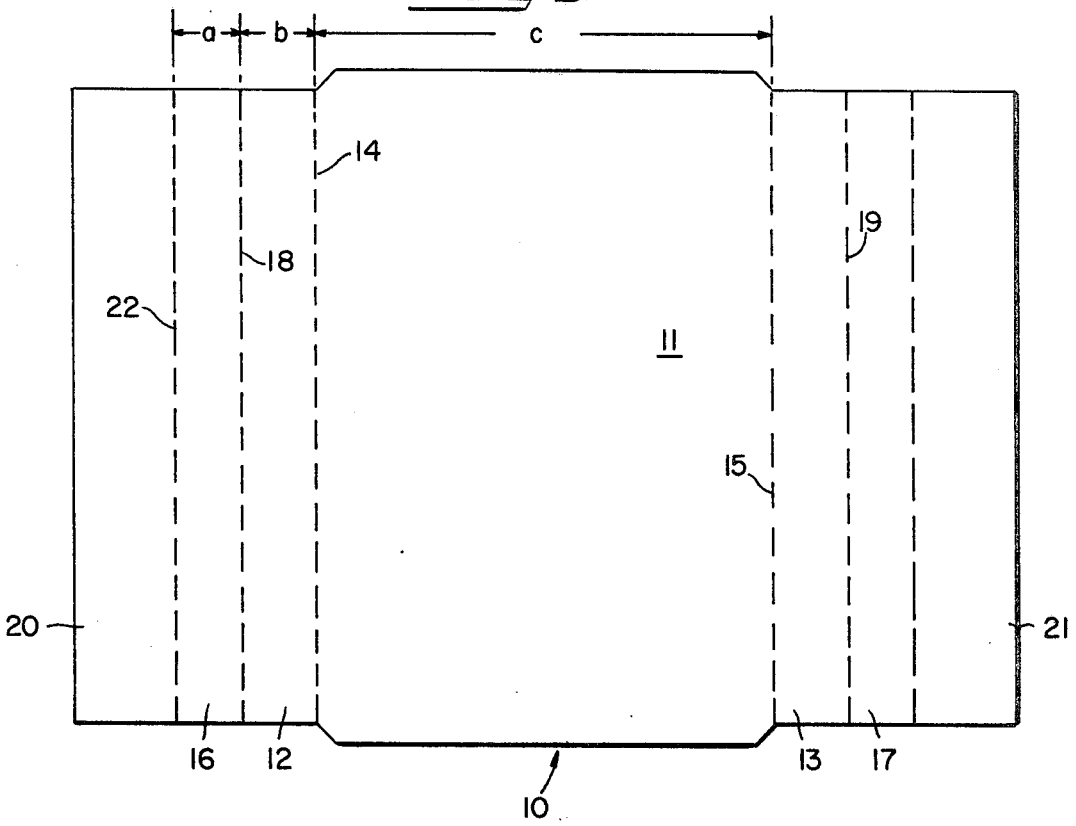
FIG. 6 is a plan view of the blank for making the sliding lid of the present invention.

Referring once again to the blank structure 10 shown in FIG. 6, the central panel 11 is shown as having a width "c" between score lines 14 and 15. In like manner, the symmetrically arranged additional panels 12 and 13 having a designated width "b" and panels 16,17 have a designated width "a". The width "b" for panels 12 and 13 is more-or-less arbitrary and is determined by the height of the tray and the amount of overlap desired for the tray side walls by the lid side flaps 7 and 8. Meanwhile, the width "a" of panels 16 and 17 is always less than the width "b" of its adjacent panel. Typical dimensions for such panels would be a width "b" of about one inch and a width "a" of about seven-eighths of an inch. The difference in the width dimensions is necessary in order to provide an angular orientation to the lid side flaps 7,8 that is substantially the same as the angular orientation of the tray side walls 3,4.

Figure 7:
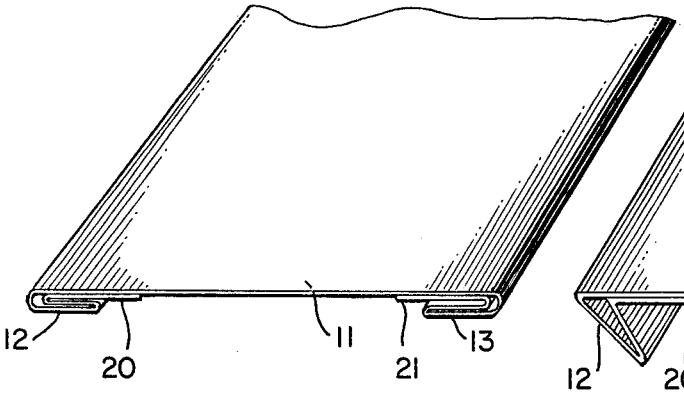
FIG. 7 is a partial perspective view of the folded and glued blank of FIG. 6.
Figure 8:
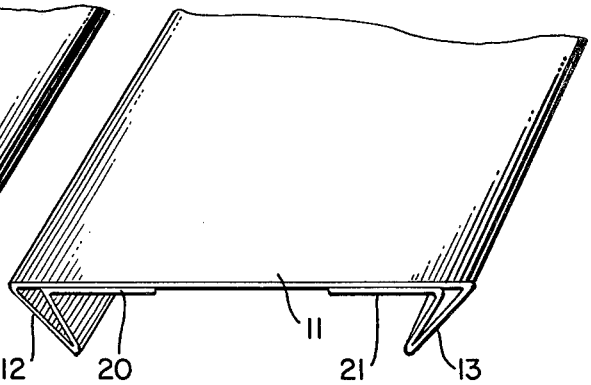
FIG. 8 is a partial perspective view of the sliding lid with the side flaps in relaxed condition; and, FIG. 9 is an enlarged end view of the sliding lid showing the differential between the angular relationship between the inside and outside panels which form the side flaps of the sliding lid.
Figure 9:
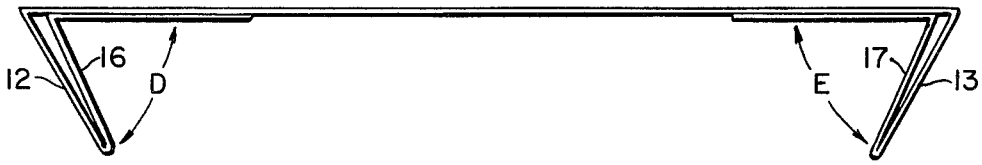

Lid 6 is formed from the blank 10 with the following folding sequence. Initially, panel 16 and glue flap 20 at one side of the blank 10, and panel 17 and glue flap 21 at the opposite side are folded over along score lines 18 and 19 respectively toward the underside of the lid. Secondly the glue flaps 20 and 21 are reversely folded along score lines 22 and 23 to turn up the glue flaps whereupon glue is applied to the exposed surfaces thereof. Finally, the now accordian folded panels at each side of the blank 10 are folded over to adhere the glue flaps 20 and 21 to the inside of the lid central panel 11. The blank in this form assumes the shape shown in FIG. 7. Subsequently, when the folded panels 12,16 and 13,17 are allowed to relax, they assume the position shown in FIG. 8. However, as shown in FIGS. 8 and 9, since the inside panels 16 and 17 are narrower than the outside panels 12,13 and since both sets of panels are folded over center before the glue flaps 20,21 are fixed in place, it is substantially impossible for the lid side flaps 7,8 to move beyond the designated angular condition. Thus, ideally the dimensions of the panels "a" and "b" are pre-determined so that the inside panels 16,17 will assume angles D and E with respect to the central panel 11 which angles substantially coincide with the angular orientation of the tray side walls. When this criteria is met, the outside panels 12 and 13 will assume slightly smaller angles with respect to the central panel 11 to effectively retain the inside panels 16,17 in their designed location. Accordingly, when the lid 6 is applied to the tray 5, the lid side flaps 7,8 assume a tight grip on the tray side walls 3,4. Meanwhile, as shown in FIG. 3, the addition of an integral handle 9 to the lid 6 serves two purposes. First the complete package is more readily picked up with the handle 9, and secondly when the package is picked up by handle 9, the moment arms created by the central panel portions between handle 9 and side flaps 7,8 creates an even greater gripping action for the tray side walls.

Although the carton shown in the drawings is of rectangular tray-like construction, the concept of the present invention is not so limited. The sliding lid disclosed herein could be used on a carton of any desired shape as long as the tray has at least two opposed angular sides and no flange. In addition, the material of construction is not critical to the present invention although the preferred material is paperboard, or thermally stable paperboard, or coated thermally stable paperboard. In general, the sliding lid disclosed herein could be formed from any material capable of being prepared in blank form and then shaped into its lid configuration.

Accordingly, while only two embodiments of the present invention are fully disclosed herein, it will be appreciated that other constructions may be devised, which, nevertheless, could come within the scope of the invention as defined in the appended claims.

I claim:

1. A sliding lid for an open top tapered tray without a flange, said lid comprising a central panel, side flaps foldably attached along two opposed side edges of said panel, and a pair of glue flaps foldably attached to said side flaps, the improvement wherein said glue flaps are adhered to said central panel inwardly of said side flaps and each side flap comprises two panels which are foldably attached to one another and arranged to lie adjacent to one another in planes which are angularly oriented with respect to said central panel.

2. The sliding lid of claim 1 wherein the lengths of said side flap panels and glue flaps are substantially equal to the length of the central panel sides to which they are attached and said side flap panels and glue flaps are symmetrically arranged on each side of said central panel.

3. The sliding lid of claim 2 wherein said side flap panels comprise inside panels and outside panels, said outside panels being wider than said inside panels.

4. The sliding lid of claim 3 wherein the glue flaps are adhered to the bottom of said central panel in such a manner that the inside and outside panels are folded into and retained in an overcenter condition to achieve their angular orientation with respect to said central panel.

5. The sliding lid of claim 4 wherein the inside panels form slightly greater angles with respect to the central panel than the angles formed by said outside panels.

6. The sliding lid of claim 5 wherein said central panel includes an integral handle portion which extends above said central panel.

7. a carton for packaging, storing or heating food comprising, in combination, an open top tapered tray without a flange and a sliding lid for said tray, said tray having at least one pair of opposed side walls that are angularly oriented with respect to the bottom of said tray, said lid comprising a central panel that is slightly wider than the width of said tray between its opposed angularly oriented side walls, a pair of side flaps foldably attached along opposed edges of said central panel, said side flaps each comprising inside panels and outside panels which are foldably attached to one another and arranged to lie adjacent to one another, and a pair of glue flaps foldably attached respectively to said side flap panels and adhered to said central panel in such a manner that the inside and outside panels are folded into and retained in an overcenter condition to achieve and angular orientation of said side flaps with respect to said central panel.

8. The carton of claim 7 wherein the inside panels of said side flaps form slightly greater angles with respect to the central panel than the angles formed by said outside panels.

9. the carton of claim 8 wherein the angular orientation of said inside panels is substantially the same as the angular orientation of said tray side walls so that the side flaps of said sliding lid grip the side walls of said tray when the lid is slid over said tray.

* * * * *